US011225757B2

(12) United States Patent
Jung et al.

(10) Patent No.: US 11,225,757 B2
(45) Date of Patent: Jan. 18, 2022

(54) BARRIER LAMINATE WITH EXCELLENT BARRIER PROPERTIES AGAINST MOISTURE AND GAS AND METHOD OF MANUFACTURING SAME

(71) Applicant: HANSOL PAPER CO., LTD., Seoul (KR)

(72) Inventors: Ha Yoon Jung, Daejeon (KR); Ji Su Jang, Daejeon (KR); Sang Hoon Oh, Gyeonggi-do (KR)

(73) Assignee: Hansol Paper Co., Ltd., Seoul (KR)

( * ) Notice: Subject to any disclaimer, the term of this patent is extended or adjusted under 35 U.S.C. 154(b) by 0 days.

(21) Appl. No.: 16/619,337

(22) PCT Filed: Jun. 11, 2019

(86) PCT No.: PCT/KR2019/007022
§ 371 (c)(1),
(2) Date: Dec. 4, 2019

(87) PCT Pub. No.: WO2020/013458
PCT Pub. Date: Jan. 16, 2020

(65) Prior Publication Data

US 2020/0291580 A1 Sep. 17, 2020

(30) Foreign Application Priority Data

Jul. 9, 2018 (KR) ..... 10-2018-0079142

(51) Int. Cl.

| | |
|---|---|
| ***D21H 21/16*** | (2006.01) |
| ***D21H 17/33*** | (2006.01) |
| ***D21H 19/20*** | (2006.01) |
| ***D21H 19/34*** | (2006.01) |
| ***D21H 19/82*** | (2006.01) |
| ***D21H 23/56*** | (2006.01) |
| ***D21H 27/10*** | (2006.01) |

(52) U.S. Cl.
CPC ..... *D21H 21/16* (2013.01); *D21H 17/33* (2013.01); *D21H 19/20* (2013.01); *D21H 19/34* (2013.01); *D21H 19/824* (2013.01); *D21H 23/56* (2013.01); *D21H 27/10* (2013.01)

(58) Field of Classification Search
USPC ..... 162/180
See application file for complete search history.

(56) References Cited

U.S. PATENT DOCUMENTS

| | | | |
|---|---|---|---|
| 2012/0114917 | A1 | 5/2012 | Anderson et al. |
| 2013/0004687 | A1 | 1/2013 | Oomori et al. |

FOREIGN PATENT DOCUMENTS

| | | | |
|---|---|---|---|
| EP | 2777934 | A1 | 9/2014 |
| JP | S46-14742 | A1 | 4/1971 |
| JP | S64-10338 | B2 | 2/1989 |
| JP | 10-249978 | A | 9/1998 |
| JP | 2002-294187 | A | 10/2002 |
| JP | 5001185 | B2 | 8/2012 |
| JP | 2012-200990 | A | 10/2012 |
| JP | 2014-9413 | A | 1/2014 |
| JP | 2014-181409 | A | 9/2014 |
| JP | 2017-14654 | A | 1/2017 |
| WO | 2011-118521 | A1 | 9/2011 |
| WO | 2015-032432 | A1 | 3/2015 |

OTHER PUBLICATIONS

Office Action from co-pending Japanese Patent Application No. 2020-505343 dated Feb. 24, 2021.
Search Report from co-pending European Application No. 19808950.0 dated Mar. 24, 2020.
International Search Report for Application No. PCT/KR2019/007022 dated Sep. 17, 2019. (no translation).
Office Action from copending Korean Application No. 10-2018-0079142 dated Nov. 20, 2018.

*Primary Examiner* — Mark Halpern
(74) *Attorney, Agent, or Firm* — Christensen Fonder Dardi; Andrew H. Auderieth; Peter S. Dardi

(57) ABSTRACT

The present invention provides a method for manufacturing a barrier laminate in which barrier materials is directly coated on a paper substrate, by suppressing penetration of barrier materials into paper through the paper surface sizing or coating process and increasing density and smoothness of the paper through the calendering process.

18 Claims, 1 Drawing Sheet

[Fig. 1]
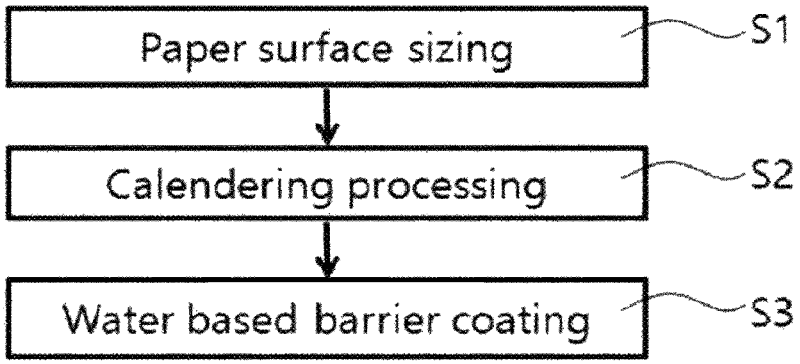
[Fig. 2]
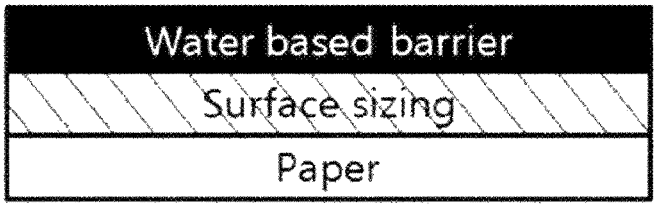

BARRIER LAMINATE WITH EXCELLENT BARRIER PROPERTIES AGAINST MOISTURE AND GAS AND METHOD OF MANUFACTURING SAME

CROSS REFERENCE TO RELATED APPLICATIONS

This application is a National Stage filing of PCT Application No. PCT/KR2019/007022 filed Jun. 11, 2019, entitled "BARRIER LAMINATE WITH EXCELLENT BARRIER PROPERTIES AGAINST MOISTURE AND GAS AND METHOD OF MANUFACTURING SAME", which claims priority to Korean Patent Application No. 10-2018-0079142 filed Jul. 9, 2018, both of which are incorporated herein by reference.

BACKGROUND OF THE INVENTION

1. Field of the Invention

The present invention relates to a barrier laminate with excellent barrier properties against water and gas, and a method of manufacturing same.

2. Description of the Related Art

Packaging materials used in food packaging require physical properties for blocking the entry of oxygen, moisture and other gases that can cause food deformation in order to suppress the decay or rancidity of contents and to maintain the function and appearance of food. For this reason, high barrier films, aluminum, etc. are used for the conventional packaging material in order to provide gas barrier property. However, high barrier films are expensive, and there are a number of problems such as the need to treat metal materials such as aluminum as non-combustible materials upon disposal after use.

Therefore, papers coated with a polymer such as polyethylene (PE) have been used in a wide range of disposable containers. In general, polyethylene coated papers are produced by extrusion coating of polyethylene on one or both sides of the paper, thereby collectively referred to as a paper that serves to prevent leakage of contents and absorption of moisture.

Polyethylene coated paper has excellent moisture barrier properties and blocks moisture. However, this paper has a disadvantage in that the barrier property against oxygen is low and the contents are oxidized and decayed when manufactured into a container. Therefore, in order to prevent oxidation, decay, etc. of food due to contact with oxygen and to allow for long-term preservation, an aluminum coating layer may be introduced like Tetra Pak to impart oxygen barrier properties or coating with nylon, EVOH or the like may be introduced. However, the introduction of an aluminum coating layer requires not only aluminum which is an expensive material but also an expensive process. In addition, nylon and EVOH are not only expensive but also require an additional bonding layer.

In addition, polyethylene, which is a representative nonpolar resin, has low adhesion to paper. In order to improve the adhesion to paper, there are difficulties in that the polyethylene is extruded and thermally oxidized at a high temperature of 300° C. to 350° C. to induce polar groups onto the melt surface, thereby coating on the paper.

SUMMARY OF THE INVENTION

A problem to be solved by the present invention is to provide a high barrier substrate having a barrier layer having excellent moisture and gas barrier properties.

Other problem to be solved by the present invention is to provide a method for manufacturing the high barrier substrate.

In addition, another problem to be solved by the present invention is to provide a soft packaging material made of the high barrier substrate.

In order to solve the problems of the present invention, the present invention provides a barrier laminate comprising a paper substrate and a barrier layer formed directly on the paper substrate, wherein the barrier layer is a single layer for blocking gas and moisture simultaneously.

The barrier layer may comprise one or more polymers and copolymers selected from styrene-butadiene polymer, styrene-acrylic polymer, polyvinyl alcohol, polyvinylidene chloride, polyacrylonitrile, polyvinyl chloride, and polyethylene vinyl alcohol.

According to one embodiment, the paper substrate may be surface-treated by sizing or coating and calendered.

According to one embodiment, the barrier layer may comprise polyvinylidene chloride or a copolymer thereof.

According to one embodiment, the polyvinylindene chloride or a copolymer thereof may be a copolymer of polyvinylidene chloride and vinyl chloride or acrylonitrile.

According to one embodiment, the paper substrate may be surface-treated by sizing or coating with at least one surface treatment selected from starch, polyvinyl alcohol (PVA) and carboxymethyl cellulose (CMC).

According to one embodiment, the paper substrate may have a bulk volume of 0.8 to 1.2 $cm^3/g$.

In addition, the paper substrate may have a smoothness of 1,800 to 2,300 seconds.

According to one embodiment, the paper substrate has an air transmission rate of 1 ml/min or less.

According to one embodiment, the laminate may have an oxygen transmission rate of 0.01 to 10 $cc/m^2 \cdot day$ and a moisture vapor transmission rate of 0.01 to 10 $g/m^2 \cdot day$.

In addition, in order to solve the other problem, the present invention provides a method for manufacturing the barrier laminate, comprising the steps of:

sizing or coating a paper substrate to perform surface treatment;

increasing a density of the surface-treated paper substrate through a calendering process;

forming a barrier layer by applying an aqueous coating solution containing polymer on the paper substrate after the calendering process; and drying the aqueous coating solution.

According to one embodiment, the calendering process may be performed at a process condition of a pressure 200 kN or more and a heating roll temperature 90 to 160° C.

According to one embodiment, the aqueous coating solution containing polymer may have a solid content of 40 to 60 wt %, a pH of 1 to 5, a viscosity of 10 to 50 mPa·s, a surface tension of 30 to 80 mN/m, an average particle diameter of 100 to 130 nm and a minimum film-forming temperature of 10 to 25° C.

According to one embodiment, the aqueous coating solution may comprise at least one inorganic pigment selected from kaolin, nanoclay, calcium carbonate, titanium dioxide, colloidal silica and delaminated clay.

According to one embodiment, the aqueous coating solution may further comprise at least one selected from a pH adjusting agent, an antifoaming agent and a curing agent.

According to one embodiment, the paper substrate may have a bulk volume of 1.4 to 1.8 $cm^3/g$, a smoothness of 10 seconds or more and an air transmission rate of 15 ml/min or more.

According to one embodiment, the coating amount of the aqueous coating solution may be 5 to 20 $g/m^2$ on a dry weight basis.

According to one embodiment, the bulk volume of the paper substrate after the calendering process may be 0.8~1.2 $cm^3/g$.

According to one embodiment, the smoothness of the paper substrate after the calendering process may be 1,800 to 2,300 seconds.

According to an embodiment, the air transmission rate of the paper substrate after the calendering process may be 1 ml/min or less.

According to one embodiment, the thickness of the paper substrate after the calendering process may be compressed to 70% or less of the initial thickness.

In addition, the present invention provides a soft packaging material made of the high barrier laminate.

EFFECT OF THE INVENTION

The present invention relates to a laminate having excellent oxygen and moisture barrier properties. By performing a water-based barrier coating after the calendering process of the paper substrate, it is possible to form a barrier layer more efficiently, thereby improving the oxygen and moisture barrier properties of the coated paper. In addition, the present invention can reduce the amount of use and the amount of carbon emissions of the material for forming the barrier film by directly applying a water-based barrier coating on the paper. Therefore, it is possible to manufacture a paper with excellent barrier properties in a more environmentally friendly way.

BRIEF DESCRIPTION OF THE DRAWINGS

FIG. 1 is a flow chart of the manufacturing process of the barrier laminate according to one embodiment.

FIG. 2 is a cross-sectional view of the barrier laminate according to one embodiment.

DETAILED DESCRIPTION OF THE INVENTION

Since various modifications and variations can be made in the present invention, particular embodiments are illustrated in the drawings and will be described in detail in the detailed description. It should be understood, however, that the invention is not intended to be limited to the particular embodiments, but includes all modifications, equivalents, and alternatives falling within the spirit and scope of the invention. In the following description of the present invention, detailed description of known functions will be omitted if it is determined that it may obscure the gist of the present invention.

Conventional barrier films have been prepared by depositing aluminum or SiOx or by coating barrier materials (PVDC, EVOH, PVA, etc.) on the films. However, when the barrier layer is directly applied to the paper, there is a problem that the film is not formed properly because the barrier material is not evenly formed on the surface of the paper due to surface variations and voids of the paper.

In order to solve these conventional problems, the present invention provides a barrier laminate comprising a paper substrate and a barrier layer formed directly on the paper substrate, the barrier layer being a single layer for blocking gas and moisture simultaneously.

The barrier laminate according to the present invention may be manufactured by the method comprising the steps of:

sizing or coating a paper substrate to perform surface treatment;

increasing a density of the surface-treated paper substrate through a calendering process;

forming a barrier layer by applying an aqueous coating solution containing polymer thereof on the paper substrate after the calendering process; and drying the aqueous coating solution.

FIG. 1 is a flow chart of the manufacturing process of the barrier laminate according to the present invention. Referring to FIG. 1, the surface of the paper is treated with a material having its own barrier property in order to suppress penetration of the paper (S1), a calendering process of pressing the paper with heat and pressure is performed to improve the density of the paper and evenness of the surface (S2), and then a coating film is formed with an aqueous coating liquid (S3), thereby preparing a barrier laminate with high moisture and gas barrier properties. FIG. 2 is a cross-sectional view of the barrier laminate produced by the manufacturing method according to the present invention.

According to the present invention, by performing a calendering process after a surface treatment process but before a coating process of the barrier coating film, it is possible to not only improve the density of the paper (i.e., reduces the bulk), but also form a barrier coating layer to be coated on the paper substrate more evenly on the surface of the paper, thereby significantly increasing the moisture and gas barrier properties.

According to one embodiment, the calendering process is preferably carried out by a super-calendering process, with a speed of 300 m/min or more, for example, 300~450 m/min and a pressure of 200 kN or more, preferably 250 kN or more, for example, 200~400 kN. The temperature of the heating roll may be 90~160° C. The calendering process may be performed repeatedly one or more times for smoothness and gloss.

According to one embodiment, after the calendering process, the paper substrate may be compressed to a thickness of 70% or less relative to the initial thickness, for example, 50 to 70%, preferably 50 to 60%.

According to one embodiment, if the bulk volume of the paper substrate is 1.4 to 1.8 $cm^3/g$, the bulk volume of the paper substrate after the calendering process may be 0.80 to 1.2 $cm^3/g$, more preferably 0.85 to 1.0 $cm^3/g \cdot day$. With regard to the bulk volume of the paper, the lower the value, the higher the density, that is, the denser the tissue.

In addition, the surface of the paper substrate may be more flattened after the calendering process. For example, the smoothness of the paper substrate may be evaluated based on the time taken for 10 ml of air to pass between the sample and the glass. If the smoothness of the paper substrate is 10 seconds or more, the smoothness of the paper substrate after the calendering process may be 1,800 to 2,300 seconds.

In addition, the paper substrate after the calendering process may have a significantly reduced air transmission rate compared to the base paper, for example, the air transmission rate may be 1 ml/min or less, preferably 0.6 ml/min or less.

Surface treatment for sizing or coating the paper substrate may include one or more selected from starch, starch derivatives, polyvinyl alcohol (PVA), carboxymethyl cellulose (CMC), latex, and mixtures thereof. For example, the surface treatment may include polyvinyl alcohol (PVA) having its own barrier properties. In addition to the above components, it may include 1 to 50% by weight of a cationic resin.

The starch may be a raw starch purified from a substance selected from rice, corn, waxy corn, barley, wheat, potato and tapioca. The starch derivative may be a starch derivative prepared by acid treatment, enzyme treatment, oxidation, esterification or etherification of the above substance. For example, there may be used a starch derivative obtained by mixing a raw starch and a modified starch with a lowered molecular weight in a molar ratio of 1:19 to 19:1, and then etherifying and esterifying with a cationic substituent.

The surface treatment may be used in 1 to 5% by weight (or parts by weight) based on the total weight of the paper substrate (or based on 100 parts by weight of pulp).

As the barrier material included in the aqueous coating solution, a polymer containing no hydrophilic group may be used to effectively inhibit moisture penetration that may occur due to hydrophilicity of the paper. For example, it may include one or more polymers or copolymers selected from styrene-butadiene, styrene-acrylic, polyvinyl alcohol, vinylidene chloride polymer, acrylonitrile polymer, vinyl chloride polymer and ethylene vinyl alcohol polymer. For example, polyvinylidene chloride (PVDC) or a copolymer including the same, which has excellent gas and moisture permeation barrier properties and heat resistance may be used as the barrier material.

According to a preferred embodiment, the polymer may be a copolymer of polyvinylidene chloride (PVDC) and vinyl chloride or acrylonitrile, and a commercially available product may be used. In this case, the molecular weight of the PVDC repeating unit may be about 70~120 g/mol or 80~110 g/mol.

In addition, the aqueous coating solution containing polymer may have a solid content of 40 to 60 wt %, a pH of 1 to 5, a viscosity of 10 to 20 mPa·s, a surface tension of 40 to 80 mN/m, an average particle diameter of 100 to 130 nm, a minimum film-forming temperature of 10 to 25° C. When the coating liquid has such physical properties, the barrier property of the paper substrate can be further improved. Here, the average particle diameter means the average particle diameter of solid content unless otherwise stated.

In addition, the aqueous coating solution may comprise, in addition to the barrier material, at least one inorganic pigments selected from kaolin, nanoclay, white carbon, talc, zeolite, ground calcium carbonate, precipitated calcium carbonate, titanium dioxide, colloidal silica and delaminated clay.

In addition, the aqueous coating liquid may further comprise at least one selected from a pH adjusting agent, an antifoaming agent and a curing agent, if necessary, within the range of the amount not affecting the properties of the barrier laminate.

The coating amount of the aqueous coating solution is 5 to 20 g/m$^2$ on a dry weight basis, preferably 10 to 20 g/m$^2$. If the coating amount is less than 5 g/m$^2$, it is difficult for the coating layer to fill all the pores of the base paper, and if the coating amount is more than 20 g/m$^2$, poor drying and excessive increase in manufacturing cost may occur.

The aqueous coating solution may be coated on the paper substrate in a manner such as, but not limited to a metering size press, a spray coater, an air knife coater, a blade coater, a bar coater, a curtain coater, a flexo coater or a gravure coater.

In addition, the barrier layer was formed by double or triple coating the aqueous coating solution, and the coating layer may be formed by performing three or more coating processes.

According to the present invention, by coating a paper substrate using an aqueous coating solution containing the barrier material as described above, a barrier laminate having excellent barrier properties against water and gas can be manufactured in a more environmentally friendly manner.

The paper substrate may include chemical pulp such as laubholz bleached kraft pulp (LBKP), nadelholz bleached kraft pulp (NBKP) and sulfite pulp (SP), mechanical pulp such as stone grind pulp (SGP), thermomechanical pulp (TMP), chemical thermomechanical pulp (CTMP), deinked pulp (DIP), non-wood fibers obtained from kenaf, bamboo, hemp, and the like, and combinations thereof.

According to one embodiment, the paper substrate, that is, the base paper has a bulk volume of 1.4 to 1.8 cm$^3$/g, a smoothness of 10 seconds or more and an air transmission rate of 15 ml/min or more.

In the present invention, when a material exhibiting barrier properties such as PVA (polyvinyl alcohol) or PVDC (polyvinylidene chloride), EVOH (ethylene vinyl alcohol) is directly coated on the paper, it is difficult to form a surface film due to penetration into the paper from the nature of the porous paper. Therefore, by increasing the density of the paper through the calendering process and suppressing the paper penetration of the barrier material through the sizing process, the barrier film can be directly formed on the surface of the paper.

The barrier laminate manufactured according to the present invention may have excellent gas barrier properties and moisture barrier properties. According to one embodiment, the oxygen transmission rate of the barrier laminate may be 0.01 to 10 cc/m$^2$·day and the moisture transmission rate may be 0.01 to 10 g/m$^2$·day. The smoothness of the barrier laminate may be 110,000 to 170,000 seconds.

Since the barrier laminate according to the present invention has excellent gas barrier properties under low and high humidity, it can be applied as a soft packaging material such as a food packaging material for confectionery, coffee, bakery and powdered food. It may change the packaging of the film material to the packaging of the eco-friendly paper material beyond simply replacing the conventional packaging paper.

Regarding the environmental friendliness of the barrier laminate according to the present invention, the usage of metal materials such as plastic and aluminum may be reduced by about 45%, and thus carbon emissions may be reduced by about 48% compared to conventional barrier film packaging.

In addition, compared to the method of coating the barrier material by laminating film packaging by the conventional lamination process, the present invention can reduce the lamination process by coating the barrier material directly on the paper, the productivity can be further improved, thereby reducing the process cost.

In addition, it is possible to give a paper texture of the packaging material by changing the packaging material of the conventional polymeric film substrate to a printed matter of the paper material and it is possible to give a differentiation from the existing product and a distinct luxury of the paper material.

Hereinafter, embodiments of the present invention will be described in detail so that those skilled in the art can easily carry out the present invention. The present invention may, however, be embodied in many different forms and should not be construed as limited to the embodiments set forth herein.

PREPARATION EXAMPLE 1

After sizing treatment with polyvinyl alcohol (PVA) on a paper substrate, the density of the paper was improved by calendering the paper substrate. The calendering was performed by a Super-Calender having 13 rolls, at a speed of 350 m/min and a pressure of 300 kN with the heating roll temperature being 90 to 160° C.

The basis weight, thickness, bulk and smoothness of the base paper or the paper after sizing and calendering processes were measured as shown in Table 1 below.

[Measurement Method]

Basis weight: The weight (g) per 1 $m^2$ of the paper was measured.

Thickness: The thickness of the paper was measured using L&W Micrometer s/n 780 model.

Bulk: The ratio of paper thickness divided by basis weight, which is a concept of inverse of density.

Smoothness: The smoothness of the paper was measured in seconds using Automatic Bekk Smoothness & Porosity Test K533 model (from Buchel BV).

Air transmission rate: measured based on ISO 5636-3.

TABLE 1

| | | Base paper (Sizing X, Calendering X) | After sizing (Sizing O, Calendering X) | After calendering (Sizing O, Calendering O) |
|---|---|---|---|---|
| Basis weight | $g/m^2$ | 59.2 | 58.7 | 57.8 |
| Thickness | μm | 95.4 | 91.6 | 54.1 |
| Bulk | $cm^2/g$ | 1.61 | 1.56 | 0.94 |
| Smoothness | sec | 11 | 11 | 2,070 |
| Air transmission rate | ml/min | 88 | 10.5 | 0.4 |

EXAMPLES 1 AND 2

An aqueous coating solution was prepared containing polymer composite (the molecular weight of PVDC repeating unit is 70 to 120 g/mol or 80 to 110 g/mol) prepared by copolymerizing polyvinylidene chloride (PVDC) with vinyl chloride or acrylonitrile and having the properties shown in Table 2. The prepared aqueous coating solution was coated on a paper substrate having the surface flattened by the calendering process.

TABLE 2

| | Solid content (%) | pH | Viscosity (mPa · s) | Surface tension (mN/m) | Average particle diameter (nm) | Charge | Minimum film-forming temperature (° C.) |
|---|---|---|---|---|---|---|---|
| Example 1 | 54 | 2.0 | 15 | 51 | 110 | Anion | 13 |
| Example 2 | 54 | ~2.0 | 15 | 67 | 113 | Anion | 21 |

EXAMPLE 3

NaOH was added to the aqueous coating solution of Example 1 to adjust the pH of the aqueous coating solution to 6.

EXAMPLE 4

Ammonia water was added to the aqueous coating solution of Example 2 to adjust the pH of the aqueous coating solution to 6.

EXAMPLE 5

Double coating was performed by forming each coating layer with the aqueous coating solution of Examples 1 and 2.

EXAMPLE 6

Coating was performed by changing the coating ratio of the aqueous coating solution of Example 2.

EXAMPLE 7

Triple coating was performed with the aqueous coating solution of Example 2.

COMPARATIVE EXAMPLE 1

The aqueous coating solution of Example 1 was coated on a base paper which was not subjected to the sizing and calendering process.

COMPARATIVE EXAMPLE 2

The aqueous coating solution of Example 1 was coated on a base paper which was subjected to the sizing process but not subjected to the calendering process.

The barrier quality of the barrier laminate coated in the same manner as described above is summarized in Table 3 below.

TABLE 3

| | Coating amount $g/m^2$ | Moisture vapor transmission rate (MVTR) $g/m^2 \cdot day$ | Oxygen transmission rate (OTR) $cm^2/m^2 \cdot day$ |
|---|---|---|---|
| Example 1 | 8 + 7 | 1.2 | 0.2 |
| Example 2 | 8 + 7 | 2.5 | 0.2 |
| Example 3 | 8 + 7 | 5.7 | 9.6 |
| Example 4 | 8 + 7 | 2.1 | 0.2 |
| Example 5 | 8 + 7 | 1.1 | 0.2 |
| Example 6 | 14 + 1 | 2.6 | 0.2 |
| Example 7 | 5 + 5 + 5 | 1.9 | 0.2 |
| Comparative Example 1 | 8 + 7 | 29 | 1,780 |
| Comparative Example 2 | 8 + 7 | 11 | 18.7 |

[Measurement Method]

Moisture vapor transmission rate (MVTR): Moisture vapor transmission rate was measured at a temperature of ±0.5° C. and a relative humidity of 90±2% with MOCON Permatran-w3/33 water vapor transmission rate system.

Oxygen transmission rate (OTR): Oxygen transmission rate was measured at a temperature of 23±0.5° C. and a relative humidity of 0% with Labthink OX2/230 oxygen transmission rate (OTR) tester.

The barrier laminate coated in the above manner can be used as a food packaging material. Table 4 below shows the inspection results for determining suitability for food utensils, containers, packages of the barrier laminate according to the present invention.

TABLE 4

| Soft packaging materials 2pass | | | | | |
|---|---|---|---|---|---|
| Testing item | Unit | Reference value | Test method | Test results | Remarks |
| Residual lead (Pb) | mg/kg | 100 or less (sum) | (1) | Not detected | — |
| Residual cadmium (Cd) | mg/kg | 100 or less (sum) | (1) | Not detected | — |
| Residual mercury (Hg) | mg/kg | 100 or less (sum) | (1) | Not detected | — |
| Residual $Cr^{6+}$ | mg/kg | 100 or less (sum) | (1) | Not detected | — |
| Elution lead (Pb) | mg/L | 1 or less | (1) | Not detected | — |
| Elution consumption of potassium permanganate | mg/L | 10 or less | (1) | 1 | — |
| Elution total elution of 4% acetic acid | mg/L | 30 or less | (1) | 8 | — |
| Elution total elution of water | mg/L | 30 or less | (1) | 2 | — |
| Elution total elution of n-heptane | mg/L | 150 or less | (1) | 12 | — |
| Elution 1-hexene 4% acetic acid | mg/L | 3 or less | (1) | Not detected | — |
| Elution 1-hexene water | mg/L | 3 or less | (1) | Not detected | — |
| Elution 1-hexene n-heptane | mg/L | 3 or less | (1) | Not detected | — |
| Elution 1-octene 4% acetic acid | mg/L | 15 or less | (1) | Not detected | — |
| Elution 1-octene water | mg/L | 15 or less | (1) | Not detected | — |
| Elution 1-octene n-heptane | mg/L | 15 or less | (1) | Not detected | — |

※Test name: Food utensils, containers, packages codex, Korea Institute of Construction and Living Testing (KCL)

From the above test results, it can be seen that the barrier laminate produced by the manufacturing method according to the present invention conforms to a standard suitable for use as a food packaging material.

While the present invention has been particularly shown and described with reference to the particular embodiments thereof, it will be apparent to those skilled in the art that these specific descriptions are only preferred embodiments and that the scope of the invention is not limited thereby. Accordingly, the actual scope of the present invention will be defined by the appended claims and their equivalents.

INDUSTRIAL APPLICABILITY

The present invention can reduce the usage of materials for forming the barrier film and the carbon emissions by directly applying a water-based barrier coating on the paper. Accordingly, it is possible to manufacture a packaging material having excellent barrier properties in a more environmentally friendly way.

What is claimed is:

1. A barrier laminate comprising a paper substrate and a barrier layer formed directly on the paper substrate, wherein the barrier layer is a single layer for blocking gas and moisture simultaneously, wherein the barrier laminate has an oxygen transmission rate of 0.01 to 10 cc/m$^2$·day and a moisture vapor transmission rate of 0.01 to 10 g/m$^2$·day, and wherein the paper substrate has an air transmission rate of 1 ml/min or less.

2. The barrier laminate according to claim 1, wherein the barrier layer comprises one or more polymers or copolymers selected from styrene-butadiene polymer, styrene-acrylic polymer, vinyl alcohol copolymer, polyvinylidene chloride, polyacrylonitrile, polyvinyl chloride, and polyethylene vinyl alcohol.

3. The barrier laminate according to claim 1, wherein the paper substrate is surface-treated by sizing or coating and calendered.

4. The barrier laminate according to claim 1, wherein the barrier layer comprises polyvinylidene chloride or a copolymer thereof.

5. The barrier laminate according to claim 4, wherein the polyvinylindene chloride or a copolymer thereof is a copolymer of polyvinylidene chloride and vinyl chloride or acrylonitrile.

6. The barrier laminate according to claim 1, wherein the paper substrate is surface-treated by sizing or coating with at least one surface treatment selected from starch, polyvinyl alcohol (PVA) and carboxymethyl cellulose (CMC).

7. The barrier laminate according to claim 1, wherein the paper substrate has a bulk volume of 0.8 to 1.2 cm$^3$/g.

8. The barrier laminate according to claim 1, wherein the paper substrate has a smoothness of 1,800 to 2,300 seconds.

9. A method of manufacturing the barrier laminate according to claim 1, the method comprising the steps of:

sizing or coating a paper substrate to perform surface treatment;

increasing a density of the surface-treated paper substrate through a calendering process at a pressure of 200 kN and a heating roll temperature of 90° C. or higher;

forming a barrier layer by applying an aqueous coating solution containing polyvinylindene chloride or a copolymer thereof on the paper substrate after the calendering process; and drying the aqueous coating solution.

10. The method for manufacturing the barrier laminate according to claim 9, wherein the aqueous coating solution containing polyvinylindene chloride or a copolymer thereof has a pH of 1 to 5, a viscosity of 10 to 20 mPa·s, a surface tension of 40 to 80 mN/m, and wherein the polyvinylindene chloride or a copolymer thereof has an average particle diameter of 100 to 130 nm and a molecular weight (Mw) of 80,000 to 500,000 g/mol.

11. The method for manufacturing the barrier laminate according to claim 9, wherein the aqueous coating solution further comprises at least one selected from pH adjusting agent, an antifoaming agent and a curing agent.

12. The method for manufacturing the barrier laminate according to claim 9, wherein the paper substrate before the surface treatment by sizing or coating has a bulk volume of 1.4 to 1.8 cm$^3$/g, a smoothness of 10 seconds or more and an air transmission rate of 15 ml/min or more.

13. The method for manufacturing the barrier laminate according to claim 9, wherein the coating amount of the aqueous coating solution is 5 to 20 g/m$^2$ on a dry weight basis.

14. he method for manufacturing the barrier laminate according to claim 9, wherein the thickness of the paper substrate after the calendering process is compressed to 70% or less of the initial thickness.

15. A soft packaging material made of the high barrier laminate according to claim 1.

16. The soft packaging material according to claim 15, wherein the barrier layer comprises one or more polymers or copolymers selected from styrene-butadiene polymer, styrene-acrylic polymer, vinyl alcohol copolymer, polyvinylidene chloride, polyacrylonitrile, polyvinyl chloride, and polyethylene vinyl alcohol.

17. The soft packaging material according to claim 15, wherein the paper substrate is surface-treated by sizing or coating and calendered.

18. The soft packaging material according to claim 15, wherein the barrier layer comprises polyvinylidene chloride or a copolymer thereof.

* * * * *